United States Patent [19]

Nieviarovski

[11] 4,164,906

[45] Aug. 21, 1979

[54] SCHNABEL CAR BOGIE

[75] Inventor: Leslav M. Nieviarovski, Yonkers, N.Y.

[73] Assignee: Norca Corporation, Great Neck, N.Y.

[21] Appl. No.: 791,700

[22] Filed: Apr. 28, 1977

[51] Int. Cl.[2] ..... B61D 3/12; B61D 3/16; B61D 15/02; B61D 49/00

[52] U.S. Cl. ..... 105/367; 105/1 R; 105/183

[58] Field of Search ..... 105/159, 183, 367, 216, 105/217, 1 R

[56] References Cited

U.S. PATENT DOCUMENTS

| | | | |
|---|---|---|---|
| 1,656,995 | 1/1928 | Wenzel | 105/183 |
| 2,089,110 | 8/1937 | Bugatti | 105/183 |
| 2,915,990 | 12/1959 | Hammond | 105/216 |
| 3,532,061 | 10/1970 | Bohm et al. | 105/159 |
| 3,648,622 | 3/1972 | Lich | 105/159 |
| 3,837,295 | 9/1974 | Fedele | 105/367 |

FOREIGN PATENT DOCUMENTS

| | | | |
|---|---|---|---|
| 2414764 | 10/1975 | Fed. Rep. of Germany | 105/367 |

*Primary Examiner*—Albert J. Makay
*Assistant Examiner*—Howard Beltran
*Attorney, Agent, or Firm*—Shenier & O'Connor

[57] ABSTRACT

An improved multiple span bolster or "schnabel" car arrangement in which a first arrangement is provided for inhibiting lifting of the lower inboard span bolster in response to compressive forces when the schnabel car halves are being transported empty and in which another means is provided for inhibiting jackknifing by restricting relative pivotal movement between the upper span bolster and a lower span bolster.

20 Claims, 9 Drawing Figures

SCHNABEL CAR BOGIE

BACKGROUND OF THE INVENTION

There are known in the prior art "schnabel" or multiple span bolster cars for the transport of extremely heavy and large pieces of equipment such, for example, as large electrical transformers. Other pieces to be conveyed by such special cars would, for example, be extremely large steel sections of a bridge, or the like. These cars are made up of two halves, each of which includes a generally triangular beam pivotally supported on an upper span bolster which in turn is supported on one or two lower span bolsters. In normal use of the schnabel car arrangement when carrying a load, the lower ends of each of the triangular beams support hinges which couple the beams to the load support. The upper ends of the beams are provided with compression jacks. When the schnabel car is not being used to convey a load, the two halves usually are coupled together in some manner so as to permit the assembly to be transported empty to the site or location at which it is to receive a load.

In the course of movement of a train, the car units thereof are subjected at times to extremely heavy tension and compressive forces which may be termed draft and buff forces. These forces may, for example, be of the order of 600,000 to 1,200,000 pounds in the direction of the length of the unit. While such loads do not cause any serious problems with cars which are coupled together in the ordinary manner, they do create serious problems in the case of multiple span bolster car arrangements. For example, if the two halves of an empty schnabel car arrangement are coupled by connecting the beams and the thus assembled unit makes up part of a train, compressive forces must be transmitted from the outboard coupling through the first outboard half upper span bolster and through the first half beam pivot to the first schnabel beam. From the first schnabel beam, the force is transmitted to the second schnabel beam down through the second beam pivot to the second half upper span bolster and, finally, to the coupling on the second half outboard truck. It will readily be appreciated that the line or lines along which the forces are transmitted through the beams are considerably above the line of application of the force between couplings. As a result of this fact, there is produced a force tending to lift the inboard end of the upper bolster and thus the lower span bolster and its associated trucks off the track. Such a force clearly greatly increases the possibility of the occurrence of a derailment. Of course, usually when the schnabel car is carrying a full load, sufficient weight is applied to the beams to inhibit this occurrence.

In addition to the condition described above, in connection with the compressive forces applied to a multiple span bolster car arrangement, in any multiple span bolster car arrangement there is a considerable distance between the point at which a coupler or a drawbar is pivoted to the lower span bolster and the point at which the upper span bolster load is applied to the lower span bolster. It will further readily be appreciated that, if any misalignment between these two points exists, the relatively heavy compressive forces applied to the unit at times can induce jackknifing and resultant derailment.

I have invented an improved multiple span bolster car arrangement which overcomes the defects of multiple span bolster car arrangements of the prior art. My improved multiple span bolster car arrangement inhibits derailment of any of the trucks of the unit as a result of compressive forces applied thereto. My arrangement greatly facilitates the safe transportation of two empty schnabel car halves. My improved multiple span bolster car arrangement substantially reduces the possibility of derailment as a result of jackknifing. My arrangement is relatively simple in construction for the result achieved thereby.

My inboard coupling assembly also takes care of draft (tension) forces which can also be a problem if eccentricity between the center line of the coupler and the reaction of the car body is too large.

Another advantage of my inboard coupling arrangement is that it reduces the amount of lateral clearance necessary to accommodate two schnabel halves being transported in the manner known to the prior art as, for example, when a curve is being negotiated.

SUMMARY OF THE INVENTION

One object of my invention is to provide an improved multiple span bolster car arrangement which overcomes the defects of multiple span bolster car arrangements of the prior art.

Another object of my invention is to provide an improved multiple span bolster car arrangement which substantially reduces the danger of derailment of any of the trucks of the unit as a result of compressive loads applied to the assembly.

A still further object of my invention is to provide an arrangement for safely transporting empty schnabel car halves.

A still further object of my invention is to provide an improved multiple span bolster car arrangement which greatly reduces the possibility of jackknifing of the upper and lower span bolsters with respect to each other.

A still further object of my invention is to provide an improved multiple span bolster car arrangement which is relatively simple in construction for the results achieved thereby.

Other and further objects of my invention will appear from the following description.

In general, my invention contemplates the provision of an improved schnabel car arrangement provided with means for inhibiting lifting of the lower span bolster and its associated trucks in response to compressive forces applied to the assembly when light loads are being carried and when the car halves are being transported empty. I further provide my arrangement with means for inhibiting relative pivotal movement between the upper and lower span bolsters in response to compressive forces so as substantially to reduce the possibility of these two units from jackknifing relative to each other.

BRIEF DESCRIPTION OF THE DRAWINGS

In the accompanying drawings to which reference is made and in which like reference characters are used to indicate like parts in the various views:

FIG. 3 is a side elevation of one-half of my improved schnabel car unit with the other half being fragmentarily shown.

FIG. 9 is a partially schematic side elevation of a form of my invention employed to transport empty schnabel cars having relatively heavy beams.

DESCRIPTION OF THE PREFERRED EMBODIMENT

Figure 1:
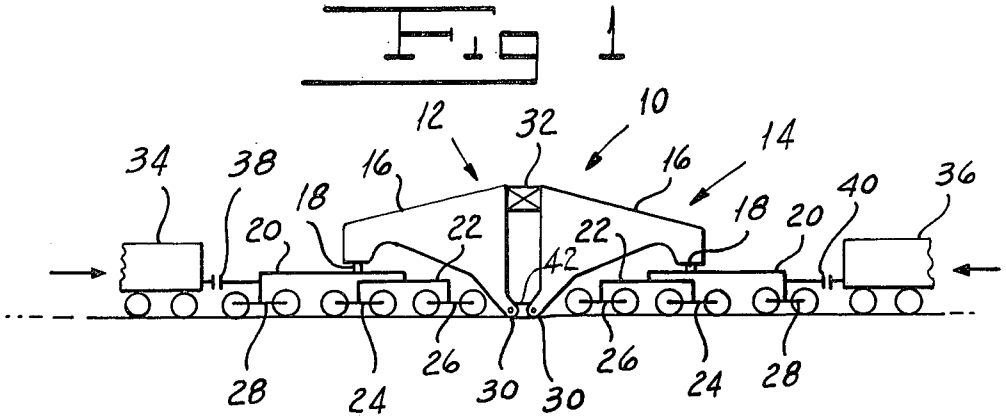
FIG. 1 is a partially diagrammatic view of a train including a pair of empty schnabel car halves as a part thereof.
Figure 2:
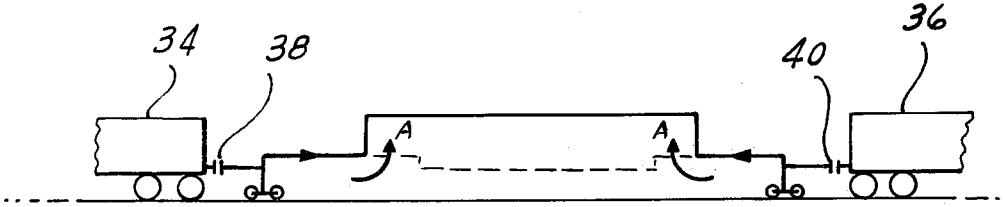
FIG. 2 is a diagrammatic view illustrating the transmission of compressive forces through the schnabel car units of FIG. 1.

Referring now to FIGS. 1 and 2, a railway schnabel car assembly, indicated generally by the reference character 10, includes a first half, indicated generally by the reference character 12, and a second half, indicated generally by the reference character 14 constitute bogie arrangements. Each of the two halves 12 and 14 includes a generally triangular beam 16 supported at a bearing point 18 on an upper span bolster 20. As is well known in the art and as shown in FIG. 3, the support at bearing point 18 includes a spherical male center plate 17 which is received in a female center plate 19 carried by the upper span bolster 20. Plate 17 is carried by a guide assembly 21 connected by a link 23 to schnabel half 12, for example. The upper span bolster 20 is supported at one end thereof on a lower span bolster 22 carried by a pair of trucks 24 and 26 for traveling on a railway. A truck 28 supports the other end of the upper span bolster 20. Each of the beams 16 includes a hinge 30 adapted to receive a hinge pin 31. The manner in which the two schnabel halves 12 and 14 are used to support a load for transport thereof is illustrated more fully in U.S. Pat. No. 3,837,295, issued Sept. 24, 1974 to Franco Fedele, for Reduced Pivot Center Distance Assembly for a Railway Car.

In the arrangement illustrated in FIG. 1 in which the two halves are being transported empty, a bolted type compression pad arrangement 32 is provided at the upper inboard ends of the beams 16. The hinge pins 31 are connected by a link or links 42. Respective cars 34 and 36 outboard of the schnabel car arrangement 10 are connected to the lower bolsters 20 by couplings 38 and 40 of a type known in the art. As has been pointed out hereinabove, in a train such as that illustrated in FIG. 1 compressive forces of relatively great magnitude are exerted in the directions of the arrows in FIG. 1. These forces must be transmitted through the schnabel car arrangement generally along the solid line indicated in FIG. 2. As a result, there are produced moments indicated by the arrows A in FIG. 2 which tend to lift the lower span bolsters 22 and their associated trucks 26 off the track. The result is a relatively great danger of derailment. It will also be appreciated by those skilled in the art that this condition exists not only in the case where the schnabel car arrangement 10 is being transported empty but also in the instance in which relatively light loads are being transported.

Figure 4:
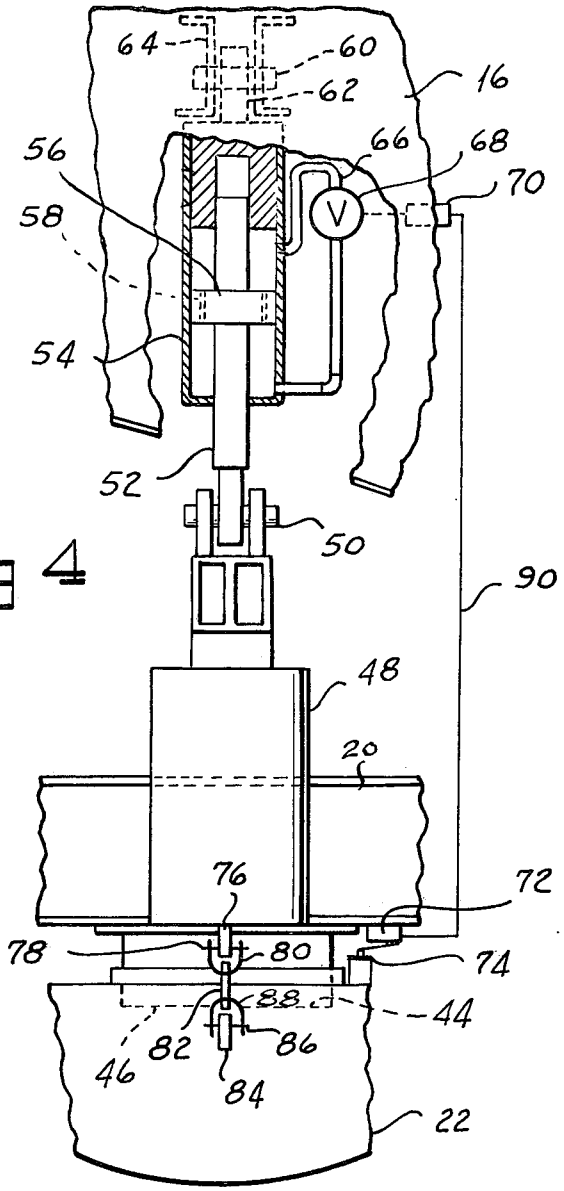
FIG. 4 is a fragmentary side elevation of a portion of the unit illustrated in FIG. 3 drawn on an enlarged scale with parts broken away and with other parts shown in section.

Referring now to FIGS. 3 and 4, a recess 44 in the lower span bolster is adapted to receive a center plate 46 carried by the upper span bolster 20. A pedestal 48 extending upwardly from the center plate carries a hinge pin 50 which pivotally connects a piston rod 52 to the pedestal 48. A cylinder 54 houses a piston 56 on rod 52. I form the piston 56 with a plurality of axially extending restricted passages 58. A lug 62 on the upper end of the cylinder 54 receives an upper pivot pin 60 carried by a frame member 64 on the beam 16. It will readily be appreciated that the cylinder 54 is filled with a suitable hydraulic fluid such, for example, as oil or the like. I provide a line 66 which connects the ends of the cylinder 54 on opposite sides of the piston 56 through a normally open valve 68. Thus, the connection 66 normally permits free flow of hydraulic fluid between the two ends of the cylinder on the opposite sides of the piston 56. A solenoid 70 is adapted to be energized in a manner to be described to close valve 68. When this occurs, any tendency of the pedestal 48 to move relative to the beam 16 is resisted by the force required to move the hydraulic fluid through the passages 58 and the head 56. A limit switch 72 on the upper span bolster 20 is adapted to be actuated by a lug 74 or the like on the lower span bolster 22 in response to a predetermined movement of the center plate 46 out of the recess 44 to energize valve 68 for the reasons set forth hereinabove. It is to be understood that cylinder 54 and its associated structure performs no function in supporting the weight of the schnabel half 12. Rather, with a compressive pad between the inboard ends of the two schnabel halves, the weight is translated through the connection provided by member 17 and 19 to the upper span bolster 20, one end of which is supported on the truck 28 and the other end of which carries the center plate 46 which rests in the recess 44 in the lower span bolster 22, which in turn is supported by trucks 24 and 26.

I provide an upper span bolster tie-down arrangement which permits a predetermined movement of the center plate 46 out of the recess 44. More specifically, a lug 76 on the pedestal 48 receives a shackle bolt 78 carried by a shackle 80. A ring or link 82 connects shackle 80 to a shackle 88 having a bolt 86 received in a lug 84 on the lower span bolster 22. As is pointed out hereinabove, I make the opening in the link 82 or the like sufficiently long to permit of a predetermined movement upwardly of the plate 46 with respect to the recess 44. Moreover, the actuator 74 and switch 72 permit a certain amount of this movement before the switch closes to close valve 68 to bring the damping action of the piston and cylinder arrangement into operation.

It is to be understood that the arrangement just described in connection with piston 56 and cylinder 54 has its particular utility in two instances. First, it can be used for lighter loads of less than, for example, 250,000 pounds. In the case of such loads, they are bolted to the beams 16 in the tension area at the inboard ends of the schnabel beams through hinge pin 31 at the compression area of the beams. Where such lighter loads are being conveyed, the hydraulic piston and cylinder arrangements come into operation upon a predetermined movement of the center plate 46 out of the recess 44 to inhibit any lifting of the lower span bolster or its supporting trucks off the way. Alternatively, this piston and cylinder arrangement can be employed for relatively short empty car movements as, at or around the installation at which the assembly is to be moved for loading. In such instance, the lower inboard ends of the schnabel halves are connected by a link or links 42 and the upper inboard ends are connected by a bolted type compression pad.

Figure 5:
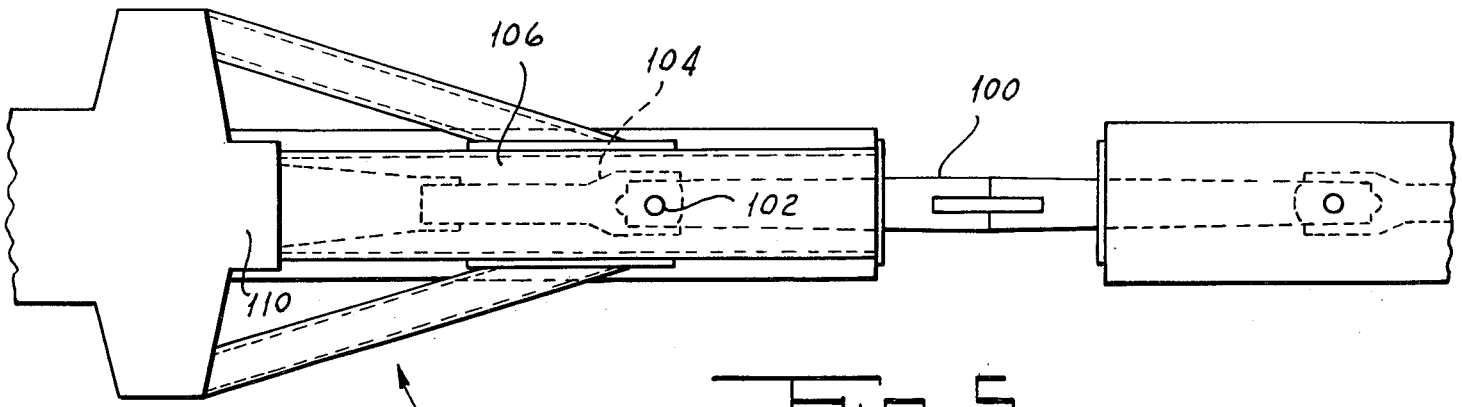
FIG. 5 is a fragmentary top plan view of a portion of the apparatus illustrated in FIG. 3 taken along the line 5—5 of FIG. 3 and drawn on an enlarged scale.

Of more importance than the short trip empty car arrangement and the light load arrangement discussed hereinabove in connection with the piston and cylinder 56 and 54 is the problem which arises where the empty schnabel car 10 is to be transported over relatively longer distances as part of a train of standard cars. My arrangement for solving the problem discussed hereinabove of the tendency of the compressive forces to lift the inboard trucks off the track for relatively longer trips on trackage of members of the Association of American Railroads, must be such as meets the relatively severe standards of the Association. Referring to FIGS. 3 and 5, my arrangement for solving this problem includes a removable pedestal, indicated generally by the reference character 92, carried by the inboard end of the upper span bolster 20. I also provide a tie-down cable 94 connected between respective lugs or ears 96 and 98 on the beam 16 and on the upper span bolster 20 to inhibit any undesirable movement of the beam. The primary function of auxiliary pedestal 92, which is an alternative to the arrangement of cylinder 54 and its associated structure is not to support the weight of the schnabel half with which it is associated. This weight is supported in the same manner as that described hereinabove in connection with cylinder 54 and its associated structure. Rather, pedestal 92 inhibits upward movement of the inboard end of the upper span bolster 20, thus to reduce the tendency of trucks 24 and 26 to jump the track in response to compressive forces applied to the unloaded assembly of two schnabel halves.

In my arrangement, I make no connections between the inboard ends of the beams 16. Rather, I connect the inner ends of the lower span bolsters 22 by means of a drawbar 100. More specifically, a pivot pin 102 connects the inner end of each drawbar to a yoke 104 of a standard railroad draft gear, for example, permitting 2⅝" of travel. Draft gear 106 is supported on a frame indicated generally by the reference character 108 which is secured to an end 110 of the lower span bolster 22 by any suitable means, such for example as by welding or the like. With drawbar 100 connecting the inboard ends of the two lower span bolsters, compressive forces through the schnabel car arrangement 10 are translated along the broken line indicated in FIG. 2. It will readily be appreciated that in this manner the tendency of the compressive forces to lift the lower span bolster and its associated trucks off the way is substantially eliminated. More specifically, the vertical eccentricity of the line along which the forces are transmitted through the schnabel unit is reduced from a number of feet to less than a foot. In effect, a multibolster car arrangement is brought back to the category of a single bolster car, so that the danger of derailment resulting from compressive forces in multiple span bolster arrangements is substantially eliminated. It will readily be appreciated that the arrangement of drawbar 100 and the associated structure thus described is used in instances in which the schnabel car arrangement 10 is being moved over relatively long distances and over trackage of members of the American Association of Railroads which require that the unit meet relatively stringent safety standards.

Figure 6:
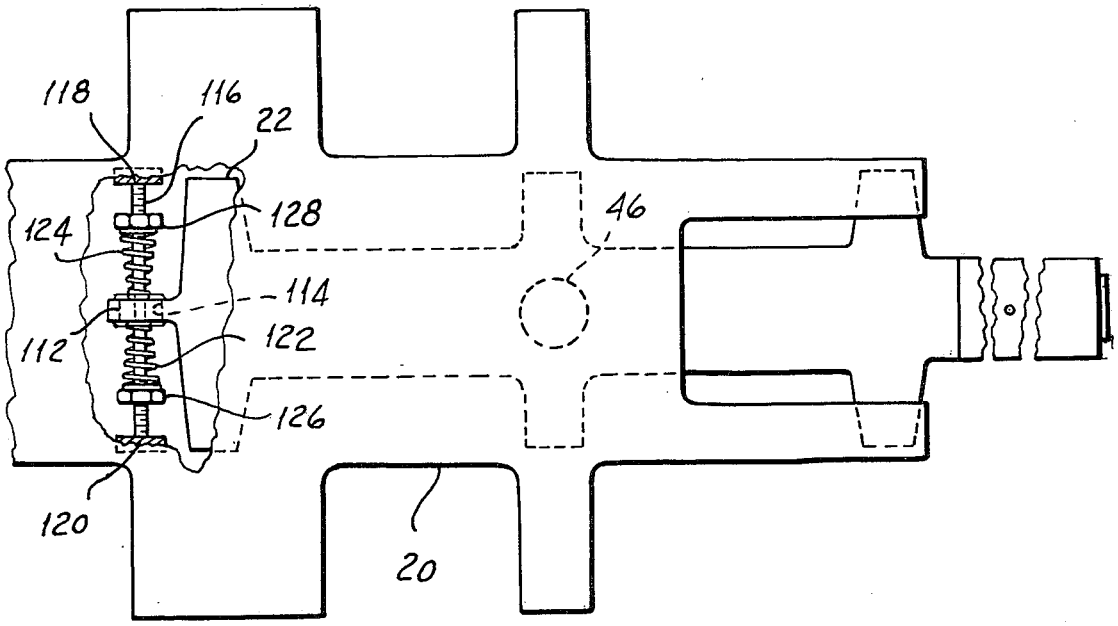
FIG. 6 is a fragmentary plan view of a portion of the apparatus of FIG. 3 with parts removed, with other parts broken away and with parts shown in section.

Referring now to FIG. 6, I have illustrated one form of my arrangement for overcoming the problem of potential jackknifing, which may occur when the center line of the bolster is not parallel to the center line of the track. That is, with the drawbar 100 making a first angle with relation to the center line of the lower span bolster and with the lower span bolster making another angle in the same direction with relation to the center line of the track there may be produced sufficient lateral forces in response to the compressive forces on the unit to cause one of the truck wheels to jump the rail. I minimize this occurrence by inhibiting the tendency of the lower span bolster 22 to misalign itself with relation to the upper span bolster 20. More specifically, I form an extension 112 on the inboard end of the lower span bolster 22. Extension 112 has an opening 114 therein to permit the passage therethrough of a threaded rod 116 carried by supports 118 and 120 on the undersurface of the upper span bolster 20. Opening 114 is sufficiently large to permit such relative pivotal movement between the upper and lower span bolsters as may be desired under certain circumstances. Respective springs 122 and 124 around the rod 116 bear between respective nuts 126 and 128 and washers or the like at the sides of the extension 112 around the opening 114. It will thus be seen that the springs 122 and 124 inhibit relatively axially displacement of the lower span bolster 22 with respect to the upper span bolster 20, thus to inhibit any tendency of the unit to jackknife. Moreover, the nuts 126 and 128 can be turned on the rod to regulate the amount of force exerted by the springs on the extension 112. When large relative movement between the two bolsters is desired, as for example at an installation at which the schnabel car is to be loaded or the like, the nuts 126 and 128 can be backed off to a sufficient distance substantially to disable the centering system.

Figure 7:
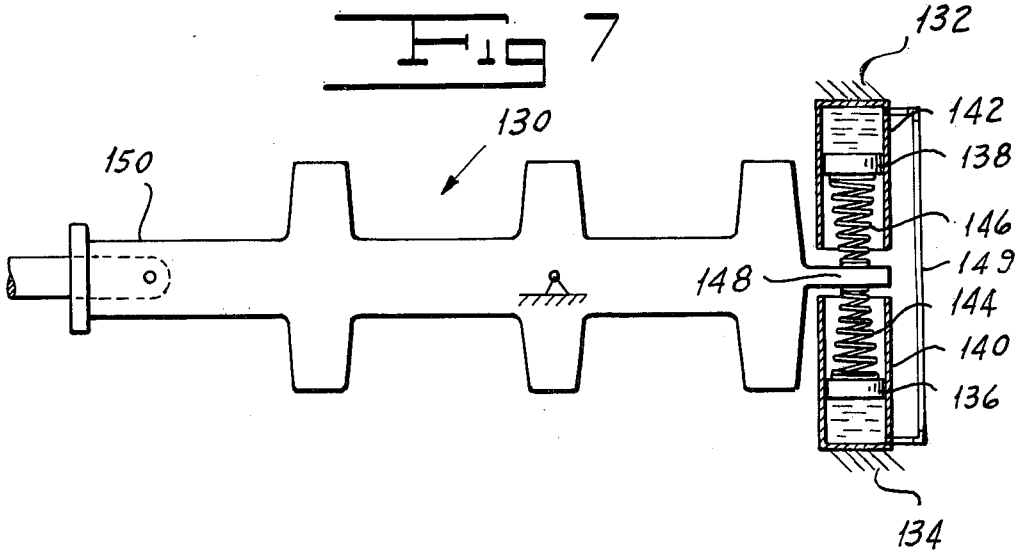
FIG. 7 is a partially schematic plan view of an alternate form of a portion of my apparatus with parts shown in section.

Referring now to FIG. 7, I have illustrated an alternate form of my anti-jackknifing arrangement which may be used, for example, in connection with an outboard lower span bolster indicated generally by the reference character 130. In certain schnabel car units, such for example as that shown and described in the Fedele Patent referred to hereinabove, each of the two halves of the unit includes an upper span bolster supported by an inboard lower span bolster and by an outboard lower span bolster. The outboard lower span bolster 130 has a draft arm 150 which receives a coupler 152 of any suitable type known to the art. In this arrangement, the inboard end of the outboard lower span bolster 130 has an extension 148. Respective supports 132 and 134 on the upper span bolster carry the rods of dash pot pistons 136 and 138 received in cylinders 140 and 142. Springs 144 and 146 bear between the respective piston heads 136 and 138 and the sides of the extension 148. I connect the ends of cylinders 140 and 142 behind the pistons 136 and 138 by a line 149. The addition of the hydraulic dash pots provided by the pistons 136 and 138 and cylinders 140 and 142 permit of the use of heavier springs. This will be apparent from the fact that on curves the force exerted on the piston heads by the springs 144 and 146 owing to the movement of extension 148 causes the relatively slow flow of fluid through the bypass line 149. However, during shock movements of extension 148 resulting from jackknifing forces, the springs absorb the force before the fluid has an opportunity to pass through the bypass line 149.

Figures 1, 8:
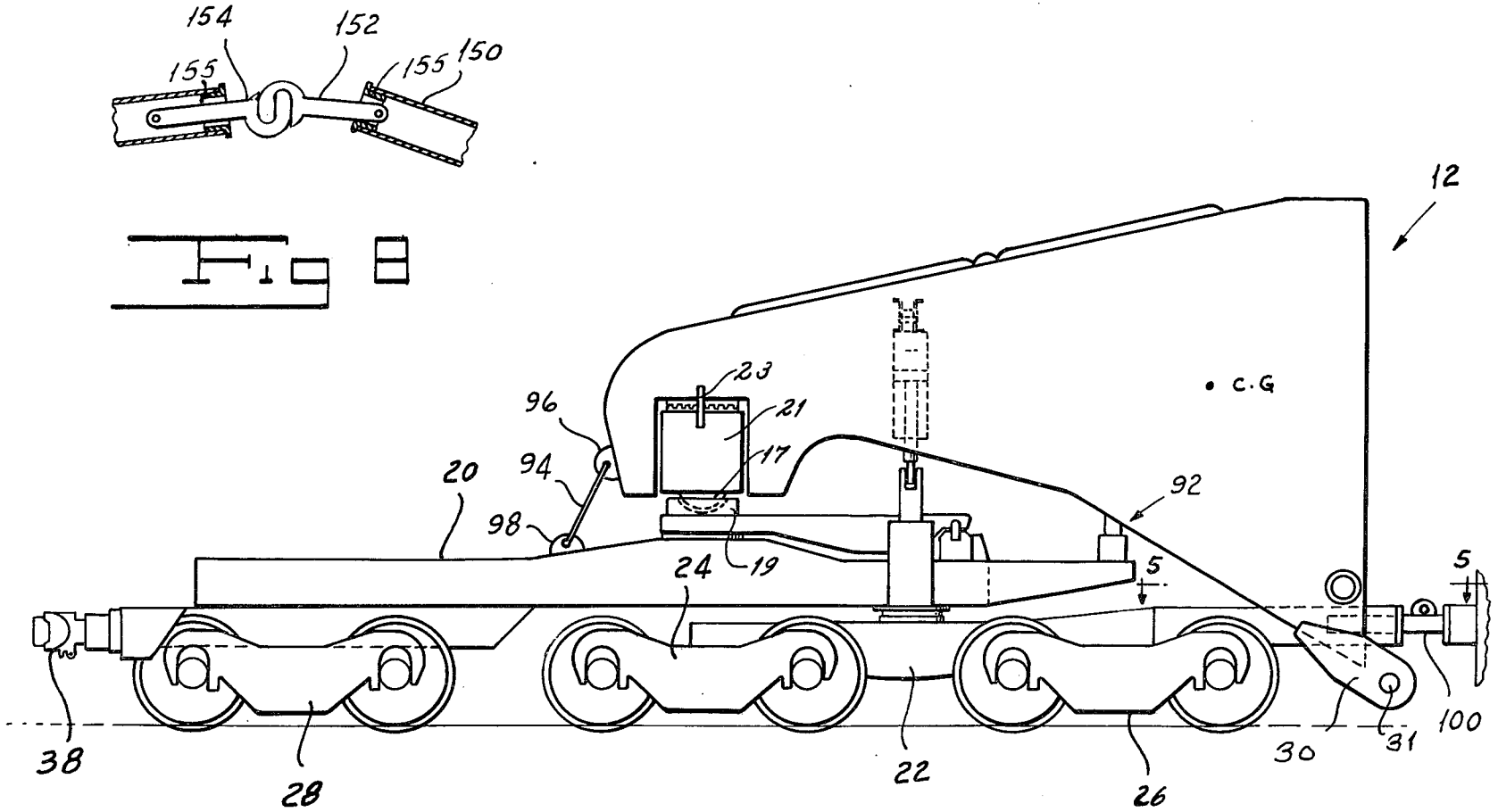
FIG. 8 is a fragmentary view of another embodiment of my apparatus with parts shown in section.
Figure 4:
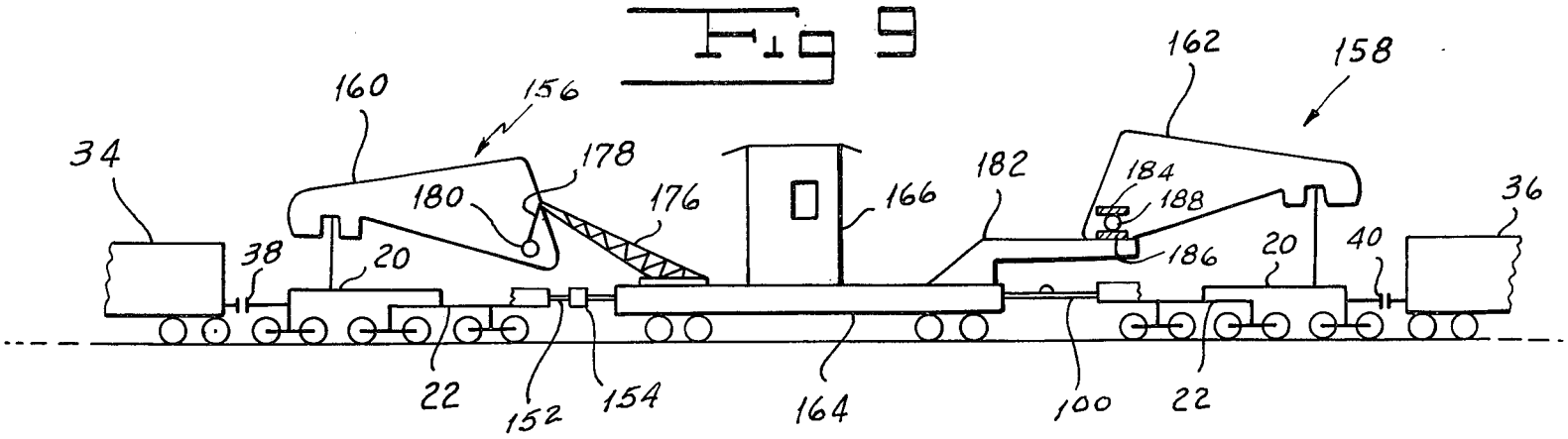

Referring now to FIG. 8, I have shown a further auxiliary means for inhibiting jackknifing of the various members. In the arrangement illustrated in FIG. 8, coupler 152 is shown in engagement with a coupler 154 which might, for example, be the coupler of a standard car. In each of the bolster draft arm 150 and the drawbar with which coupler 154 is associated, I provide removable inserts 155 of any suitable material which form a secondary stabilizing system for the couplers by limiting the pivotal movement of the couplers relative to the draft arms with which they are associated.

Referring now to FIG. 9, I have illustrated an arrangement in which I use my drawbars to provide a system for transporting empty schnabel cars which are relatively heavy. That is to say, the beams of some schnabels have stability problems owing to the weight of the beams of the units. In the arrangement illustrated in FIG. 9, respective schnabel half units, indicated generally by the reference characters 156 and 158, have beams 160 and 162. Each of the beams 160 and 162 is supported on an upper span bolster 20 which in turn is supported at its inboard end by a lower span bolster 22 and at its outboard end by a single truck. Each of the beams 160 and 162 is supported on the upper span bolster 20 in the manner described hereinbefore in connection with the schnabel halves 12 and 14. In some instances shims (not shown) are used to raise the outboard end of the schnabel some distance above the pivot 18. As in the arrangements described hereinabove, respective ordinary cars 34 and 36 outboard of the schnabel units 156 and 158 are coupled to the outboard trucks by ordinary couplers 38 and 40. In the arrangement of FIG. 9, an auxiliary car 164 carrying a cabin 166 forms part of the assembly. An arrangement such as that illustrated in FIG. 8 connects the left end of auxiliary car 164 to the unit 156 while drawbar 100 connects the right end of the car 164 to unit 158. I provide the auxiliary car with means for supporting the major portion of the weight of each of the beams 160 and 162. For example, a davit 176 adjacent to one end of the auxiliary car 164 is connected by a cable 178 or the like to an opening 180 in the beam 160. Alternatively and as shown at the other end of the car 164, ry car 164 is connected by a cable 178 or the like to an opening 180 in the beam 160. Alternatively and as shown at the other end of the car 164, a cantilever member 182 carries a bracket or the like comprising upper and lower plate-like elements 184 and 186 which receive therebetween a rod 188 or the like carried by the beam 162. It will readily be appreciated that any suitable means may be employed to provide such a connection between a cantilever member such, for example, as the member 182 and the beam 162 to support the weight thereof while permitting the required movement. That is to say, some rotatable movement between the beam and the support member must be provided. In addition, some means must prevent outward swinging movement of the beam. Preferably, the center line of the schnabel unit should be aligned with the center line of the auxiliary car 164. At the same time, enough movement must be permitted to accommodate turns. One way of accomplishing this result, other than as shown in FIG. 9, would be the provision of an ear on the schnabel with an opening therein having a diameter of approximately three times the diameter of a pin on the cantilever. Various other expedients will be apparent to those of ordinary skill in the art.

The operation of the various forms of my invention will readily be apparent from the description hereinabove. Where the piston and cylinder arrangement 56 and 54 is employed, upon a predetermined movement of the center plate 46 out of the recess 44 a valve 68 closes to prevent the flow of fluid between the ends of the cylinder 54 on opposite sides of the piston 56. Thus, relative movement between the upper span bolster 20 and the lower span bolster 22 is resisted by the resistance to flow of fluid through the openings 58 in the piston 56. This arrangement has utility where light loads are being conveyed or where empty schnabel units are being moved about in yards or the like for short distances.

Where a pair of schnabel units are to be carried empty over long distances and on trackage of members of the Association of American Railroads, the crew couples the inboard ends of the two lower span bolsters 22 by means of the drawbar 100, which is connected to the yoke 104 associated with each of the respective lower span bolsters by means of the pin 102. At the same time, the pedestal 92 is in place and the tie-down cable 94 is secured between the ears 96 and 98. It is to be understood that neither the pedestal 92 nor the tie-down cable 94 is used for in yard movement of an empty unit, wherein the piston and cylinder arrangement 56 and 54 is effective. By the same token, when the arrangement of the drawbar 100, pedestal 92 and tie-down cable 94 is being employed, the piston and cylinder unit, including the piston 56 and cylinder 54, is ineffective.

The anti-jackknifing arrangement, which may be either that of FIG. 6 or that of FIG. 7, is always effective, whether the schnabel units are loaded or empty. In each instance, the arrangement inhibits pivotal movement of the lower span bolster 22, with respect to the upper span bolster 20, so as to reduce the possibility of jackknifing of the unit.

Where instability may be present owing to the relatively great weight of the beams 160 and 162, the arrangement illustrated in FIG. 9 is employed to transport the empty schnabel units.

It will readily be appreciated that, while I have shown and described my invention in connection with schnabel cars, it is equally applicable to any type of multiple span bolster car.

I have provided an improved multiple span bolster car arrangement which overcomes the defects of multiple span bolster car arrangements of the prior art. My invention substantially reduces the danger of derailment of any of the trucks of a multiple span bolster car arrangement as a result of compressive loads applied thereto. My invention is especially adapted for use in safely transporting empty schnabel car halves. I have provided an improved multiple span bolster car arrangement which substantially reduces the possibility of jackknifing of upper and lower span bolsters with respect to each other. My arrangement is relatively simple in construction for the result achieved thereby.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. In a multiple span bolster railway car adapted to be subjected to the effect of compressive forces when making up part of a train of cars traveling along a railway, apparatus including in combination an upper span bolster, a lower span bolster for pivotally supporting the inboard end of said upper span bolster, trucks for supporting said inboard lower span bolster on said railway, means for supporting the outboard end of said upper span bolster on said railway, first means for reducing the tendency of said inboard lower span bolster to move upwardly in response to compressive forces applied to said assembly and second means for restraining said upper span bolster against pivotal movement relative to said lower span bolster to inhibit misalignment of said upper and lower span bolsters in the directions of the length thereof in response to said forces.

2. An assembly as in claim 1 in which said upper and lower span bolster comprise parts of one half of a multiple span bolster car assembly, said apparatus including a second half of said assembly, said second half including a second lower inboard span bolster, and in which said means for reducing the tendency toward upward movement of said inboard lower span bolster comprises a drawbar, means connecting the ends of said drawbar respectively to said lower inboard span bolster, said connecting means comprising pivot pins at the ends of said drawbar and means housing portions of said drawbar extending from said pins toward the longitudinal center of said drawbar to limit pivotal movement of said bar ends on said pins.

3. An assembly of a pair of empty schnabel car halves including in combination respective schnabel car halves, each of which includes a schnabel beam, an upper span bolster for supporting said beam and means including a lower inboard span bolster for supporting said upper span bolster on said way, a drawbar and, means connecting the ends of said drawbar respectively to the inboard ends of the lower inboard span bolsters, said connecting means comprising pivot pins at the ends of said drawbar and means housing portions of said drawbar extending from said pins toward the longitudinal center of said drawbar to limit pivotal movement of said bar ends on said pins a portion of each of said beams encompassing a respective end of said drawbar.

4. Apparatus as in claim 3 including a pedestal adjacent to the inboard end of said upper span bolster for supporting the weight of said schnabel beam.

5. Apparatus as in claim 4 including a tie-down between said schnabel beam and a point on said upper span bolster relatively adjacent to the outer end thereof.

6. Apparatus as in claim 5 including means for inhibiting misalignment of said upper and lower span bolsters under the action of compressive forces applied to said assembly.

7. Apparatus as in claim 6 in which said inhibiting means comprises resilient means for urging said upper and lower bolsters into longitudinal alignment.

8. A schnabel car half assembly including in combination a schnabel beam, an upper span bolster, means for pivotally supporting one end of said schnabel beam on said upper span bolster, means including an inboard lower span bolster for supporting said upper span bolster at a location inboard of said schnabel pivot, said upper span bolster supporting means comprising a truck supported member and a member adapted to move vertically with respect to said truck supported member in response to compressive forces applied to said assembly and means responsive to said upward movement inhibiting said upward movement.

9. Apparatus as in claim 8 including means normally disabling said inhibiting means and means responsive to a predetermined movement of said supporting means for rendering said disabling means inactive.

10. Apparatus as in claim 9 in which said upper span bolster supporting means comprises a recess in said lower span bolster and a centerplate on said upper span bolster received in said recess.

11. Apparatus as in claim 10 in which said inhibiting means comprises means connected between said schnabel beam and said upper span bolster.

12. Apparatus as in claim 11 in which said inhibiting means comprises a cylinder, means mounting said cylinder on one of said beam and said upper span bolster, a piston having a head disposed in said cylinder and having a rod and means connecting said rod to the other of said beam and upper span bolster, fluid disposed in said cylinder, said head being formed with restricted openings permitting limited flow of said fluid therethrough.

13. Apparatus as in claim 12 in which said disabling means comprises a line having a normally open valve therein connecting the ends of said cylinder on opposite sides of said piston head to permit the free flow of fluid through said line and in which said means responsive to a predetermined movement of said supporting means comprises means for closing said valve.

14. In a multiple span bolster arrangement adapted to be subjected to compressive forces in the direction of the length thereof when forming part of a train moving along a railway, apparatus including a lower span bolster on said railway for movement therealong, a coupler pivot adjacent to one end of said lower span bolster, said coupler adapted to be connected to a similar coupler, an upper span bolster, means on said lower span bolster spaced from said coupler pivot for pivotally supporting said upper span bolster and means for restraining said upper span bolster against pivotal movement relative to said lower span bolster to inhibit longitudinal misalignment of said bolsters with respect to each other under the action of said compressive forces.

15. Apparatus as in claim 14 in which said misalignment inhibiting means comprises resilient means between said upper and lower span bolsters.

16. Apparatus as in claim 15 in which said misalignment inhibiting means comprises a projection on one of said upper and lower span bolsters adjacent to the centerline thereof, a pair of supports on the other of said span bolsters, said supports being spaced from the centerline of the other span bolster, and respective springs disposed between said projection and said supports.

17. Apparatus as in claim 16 including means for adjusting the force exerted by said springs.

18. Apparatus for conveying empty schnabel car halves on a railway over a relatively long distance including in combination, respective first and second schnabel car halves, each of said schnabel car halves comprising a beam, an upper span bolster for pivotally supporting said beam at one side of the center of gravity thereof and means including an inboard lower span bolster for supporting said upper span bolster on said way, an auxiliary car disposed between said schnabel car halves, mating couplers on the schnabel car halves and the auxiliary car interconnecting the halves and the auxiliary car, and respective means on said auxiliary car for supporting said beams at points on the other sides of the centers of gravity thereof.

19. Apparatus as in claim 18 in which one of said beam supporting means is a davit, and a cable connecting one of said beams to said davit.

20. Apparatus as in claim 18 in which one of said beam supporting means is a cantilever beam, and means supporting one of said schnabel beams on said cantilever beam while permitting relative movement of said schnabel beam relative to said cantilever beam.

* * * * *